United States Patent [19]

Ohtsuki

[11] Patent Number: 4,488,828

[45] Date of Patent: Dec. 18, 1984

[54] TYPEWRITER FOR BRAILLE SYMBOLS AND PRINTED CHARACTERS

[76] Inventor: Naoto Ohtsuki, 60, Katakura-machi, Hachiohji, Tokyo, Japan

[21] Appl. No.: 360,679

[22] Filed: Mar. 22, 1982

[51] Int. Cl.[3] ..... B41J 3/32; B41J 3/42; B41J 3/512

[52] U.S. Cl. ..... 400/82; 400/122

[58] Field of Search ..... 400/122, 84, 124, 636.1, 400/82

[56] References Cited

U.S. PATENT DOCUMENTS

| | | | |
|---|---|---|---|
| 2,680,507 | 6/1954 | Frey et al. | 400/122 |
| 3,254,750 | 6/1966 | Goldner | 400/122 |
| 3,534,846 | 10/1970 | Watari | 400/122 |
| 3,640,368 | 2/1972 | Weinberger | 400/122 |
| 3,718,244 | 2/1973 | Bukowski et al. | 400/636.1 |
| 3,851,745 | 12/1974 | Okazaki et al. | 400/122 |
| 3,880,269 | 4/1975 | Carbonneau | 400/122 |
| 3,954,054 | 5/1976 | Busch | 400/603 |
| 4,037,705 | 7/1977 | Martin et al. | 400/124 |
| 4,173,420 | 11/1979 | Okabe | 400/636.1 |
| 4,302,116 | 11/1981 | May et al. | 400/642 |

FOREIGN PATENT DOCUMENTS

| | | | |
|---|---|---|---|
| 100174 | 7/1980 | Japan | 400/122 |
| 124688 | 9/1980 | Japan | 400/122 |
| 9313 | of 1909 | United Kingdom | 400/122 |

OTHER PUBLICATIONS

DiMarco et al., "StoHed . . . Printer" IBM Technical Disclosure Bulletin, vol. 21, No. 1, p. 238, 6/78.

DeGeorge, "Powered . . . System" IBM Technical Disclosure Bulletin, vol. 12, No. 6, p. 779, 11/69.

Heath, "Braille . . . Calculator" IBM Technical Disclosure Bulletin, vol. 23, No. 4, pp. 1727–1731, 9/80.

*Primary Examiner*—William Pieprz

*Attorney, Agent, or Firm*—Birch, Stewart, Kolasch & Birch

[57] ABSTRACT

A typewriter for Braille and printed characters including Braille character typing symbols, printed character typing symbols and a transferring member used to move both of the Braille character typing symbols and the printed character typing symbols horizontally along a recording medium. The Braille character typing symbols are actuated by solenoids whereas the printed character typing symbols are formed by a dot printer both of which are simultaneously transferred by a stepping motor. The Braille character typing symbols are disposed at opposite sides of the printed character typing symbols beneath a casing for positioning a recording medium, i.e., typing paper. Therefore, printed character symbols will appear on one side of the recording medium whereas Braille character will be embossed on the other side of the same recording medium. Thus, both a blind individual and an individual with normal vision may obtain the same recorded information which appears on the same recording medium.

10 Claims, 5 Drawing Figures

TYPEWRITER FOR BRAILLE SYMBOLS AND PRINTED CHARACTERS

FIELD OF THE INVENTION

The present invention relates to a typewriter for Braille and printed characters and more particularly to a typewriter for Braille and printed characters which can type both Braille and printed characters on the same recording medium simultaneously by using the same typing keyboard.

Many types of Braille typewriters have been developed and adopted for blind individuals. However, for the individual with normal vision, it is difficult to understand the meaning of Braille characters since most individuals are not so familiar with Braille characters. On the other hand, printed characters are an obstacle to blind individuals because of their impaired vision. Thus, the device of the present invention is preferable for both blind individuals and individuals with normal vision because Braille and printed characters may be printed on the same recording medium for better communications between the individuals. To accomplish the above purpose, many types of typewriters have been developed and introduced into the market. However, these conventional typewriters are mostly inadequate since they have many disadvantages such as high expense, complex construction and difficulties in handling.

SUMMARY AND OBJECTS OF THE PRESENT INVENTION

It is a principal object of the present invention to provide an improved typewriter for Braille and printed characters by which both a blind individual and an individual with normal vision can obtain the same contents of information appearing on the same recording medium.

It is another object of the present invention to provide an improved typewriter for Braille and printed characters in which Braille characters typing means is disposed relative to printed characters typing means so that predetermined Braille and printed characters will appear simultaneously on the same recording medium by activating the corresponding key aligned on the keyboard.

It is still another object of the present invention to provide an improved typewriter for Braille and printed characters which comprises typing means for embossing Braille characters, typing means for printing characters, transferring means for carrying the Braille characters typing means and the printed characters typing means, feeding means for supplying a recording medium, a keyboard including a plurality of keys which are selectively activated to type both a Braille and a printed character on said recording medium by means of the Braille characters typing means and the printed characters typing means and a base member in which the Braille characters typing means, the printed characters typing means, the feeding means for supplying the recording medium and the keyboard are operatively arranged.

BRIEF DESCRIPTION OF THE DRAWINGS

The foregoing and other objects, features and advantages of the present invention will be apparent from the following more particular description of a preferred embodiment of the invention as illustrated in the accompanying drawings.

DETAILED DESCRIPTION OF THE INVENTION

Figure 1:
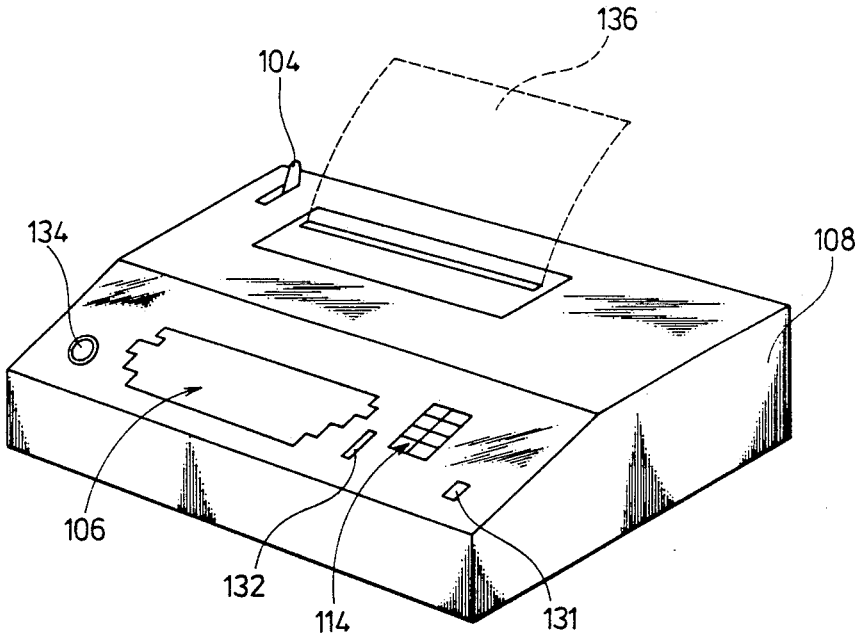
FIG. 1 is a perspective view of the typewriter for Braille and printed characters.
Figure 2:
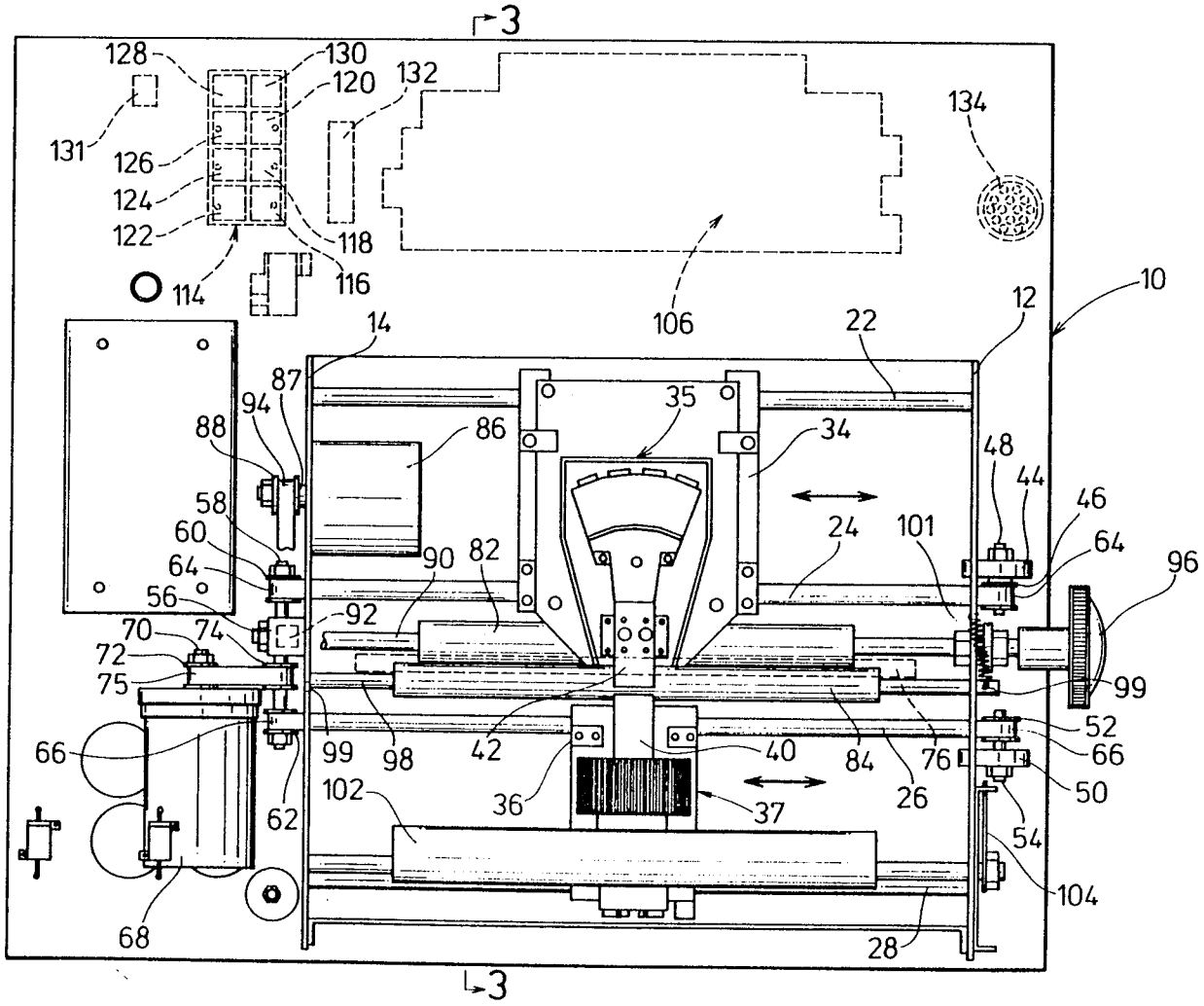
FIG. 2 is a plan view of the typewriter for Braille and printed characters of which outside casing is removed therefrom.
Figure 3:
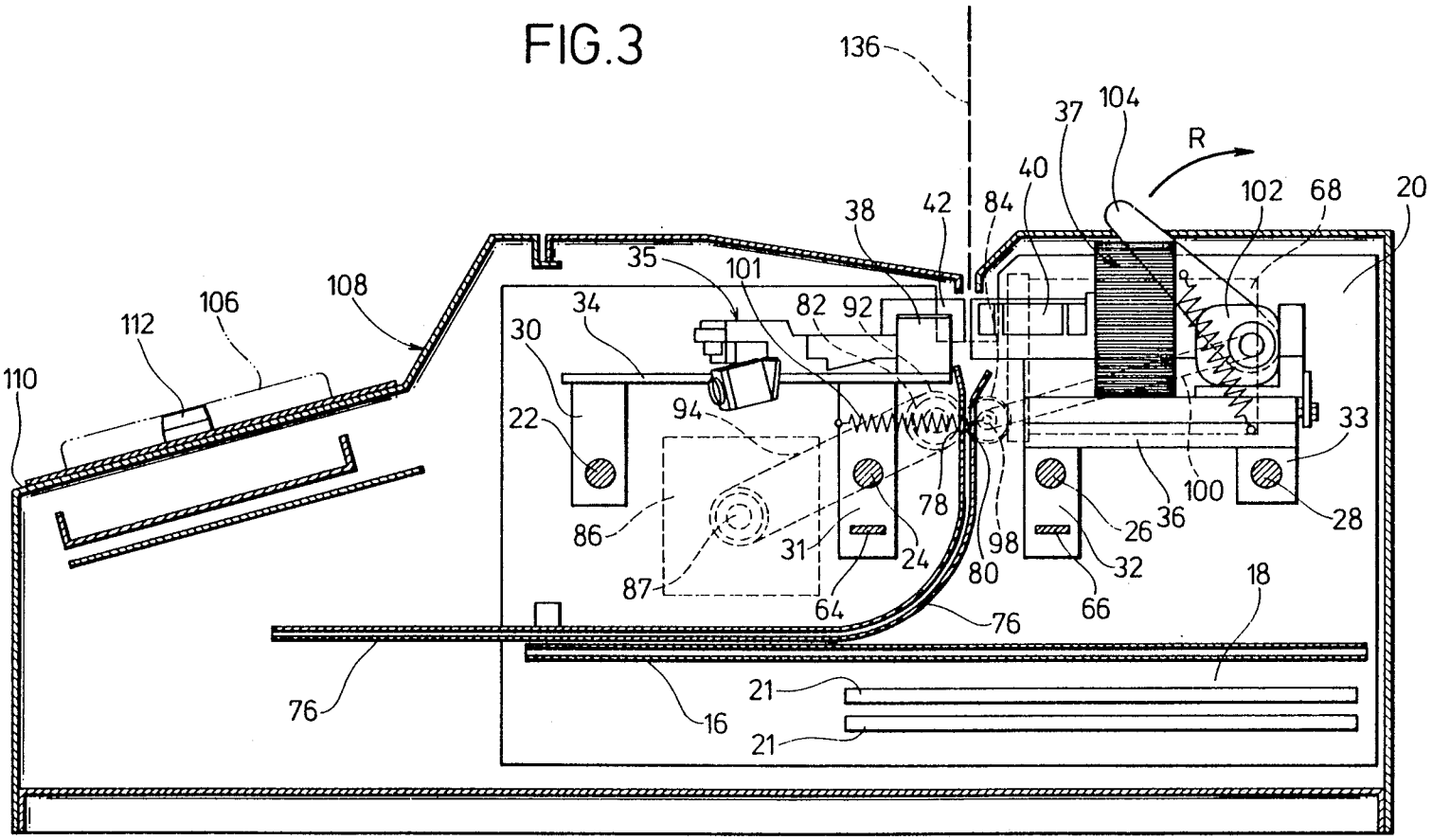
FIG. 3 is a cross-sectional view of the typewriter along the line 3—3 in FIG. 2.

Referring to FIGS. 1–3 a base member 10 is comprised of a metal plate of which is substantially in the shape of a square in plan view. A pair of support members 12 and 14 are vertically provided on the base element 10 in parallel arrangement with respect to each other and spaced a predetermined distance therebetween. The support members 12 and 14 are divided into two parts by a plate 16 disposed therebetween to define a lower section 18 and an upper section 20. The lower section 18 includes a portion of an electric circuit 21 therein which activates the typewriter in conjunction with other elements while the upper section 20 includes Braille character typing equipment, printed character typing equipment and additional equipment. Shafts 22 and 24 are bridged to the support members 12 and 14 with a predetermined distance therebetween in the front portion of upper section 20 while shafts 26 and 28 are also provided in parallel arrangement with respect to each other to bridge over the support members 12 and 14 in the rear portion of upper section 20 in the same manner as the shafts 22 and 24. The shafts 22, 24, 26 and 28 are preferably constructed from round rods of metal. The shaft 22 passes through holes provided respectively in a pair of leg members 30,30 which are disposed vertically, similarly, the shaft 24 also passes through holes defined respectively in a pair of leg members 31,31 which are disposed vertically as shown in FIG. 3. Furthermore, the shaft 26 passes through holes provided respectively in a pair of leg members 32,32 which are disposed vertically and the shaft 28 also passes through holes defined respectively in a pair of leg members 33,33 which are disposed vertically. Leg members 31,31 are larger in length than leg members 30,30 and include square holes at the end portions thereof. A plate member 34 is secured to the upper ends of the leg members 30,30 and 31,31 in order to provide a bridging surface so that a dot printer 35 of the type which is conventional may be mounted on the surface of the platform or plate member 34. Similarly, a relatively small platform or plate member 36 is secured to the upper ends of the leg members 32 and 33 in order to provide a bridging surface so that solenoids 37 may be positioned on the plate member 36. As seen in FIG. 3, the solenoids 37, used to emboss Braille characters, are placed relative to the dot printer 35 with a predetermined distance therebetween. However, the head 38 of the dot printer 35 is positioned at a different vertical orientation with respect to the head 40 of the solenoids 37 so that a receiving member 42 which faces to the head 40 of the solenoids 37 is provided on the dot printer 35. A support member 44 located under the shaft 24 is provided at the middle outside portion of the support member 12. The support member 44 supports a shaft 48 on which a pulley 46 is rotatably mounted. Similarly, a support member 50 located under the shaft 26 is provided at the middle outside portion of the support member 12 so as to support a shaft 54 on which a pulley 52 is rotatably mounted. A single support member 56 is provided at the same vertical orientation of the support members 44 and 50 on the outside surface of the support member 14. A shaft 58 is horizontally rotatably secured to the support member 56. A pair of pulleys 60 and 62 which correspond to the pulleys 46 and 52 respectively are mounted to the shaft 58. A stepped belt 64 is positioned between the pulleys 46 and 60 through square holes in the leg members 31,31 and holes (not shown) provided on the support members 12 and 14. Furthermore, a stepped belt 66 is positioned between the pulleys 52 and 62 through square holes in the leg members 32,32 and holes (not shown) provided in the support members 12 and 14. A platform moving means or stepping motor 68 is mounted on the base 10 outside the support member 14 as illustrated in FIG. 2. A pulley 72 is secured on a driving shaft 70 of the stepping motor 68. A driving belt 75 is positioned between the pulley 72 and a pulley 74 which is mounted on the shaft 58. Thus, when activating the stepping motor 68 which can rotate back and forth, the rotating power produced by the stepping motor 68 will be transmitted to the rotating shaft 58 and belts 64 and 66 so that the dot printer 35 and the solenoids 37 can move the same distance simultaneously.

A casing 76 in which a recording medium is introduced is provided under the narrow space defined between the head 38 and the head 40. As is apparent from FIG. 3, the casing 76, curved towards the front portion of the body, is comprised of a hollow flat member made of metal or synthetic resin. The upper portion of the casing 76 is flared upwardly with openings 78 and 80, being horizontally elongated in the casing 76, being defined adjacent to the lower end of the flared portion thereof. The casing 76 is supported by the plate member 16 by a conventional means such as welding or using bolts and nuts (not shown). Support members 12 and 14 rotatably support rollers 82 and 84 which have different diameters from each other. The outer surfaces of both of the rollers 82 and 84 project to touch each other through the openings 78 and 80 thereby holding the recording medium in the casing 76 and continuously feeding it upwardly as typing action is performed. A recording medium feeding motor 86 used to drive the roller 82 is provided within the support member 14. A driving shaft 87 of the motor 86 projects through the support member 14 and includes a pulley 88 mounted at the end portion thereof. A pulley 92 is mounted at one end portion of a shaft 90 passing through the roller 82 and a stepped belt 44 is positioned between the pulley 92 and pulley 88. The other end of the shaft 90 projects out of the support member 12 and includes an enlarged dial 96 mounted thereon so that the roller 82 will be able to be rotated manually. Both ends of a shaft 98 passing through the roller 84 are rotatably supported by way of enlarged holes 99 provided in the support member 12 and 14 respectively. The shaft 98 can be moved back and forth with the assistance of a lever 100 so as to be able to attach or detach the roller 84 to the roller 82. To accomplish this result, one end of a coil spring 101 is engaged with a portion of the support member 12 disposed outside with respect to the dot printer 35 whereas the other end is engaged with the shaft 98 of the roller 84. The shaft 98 is connected by a lever 100 to a shaft of an eccentric rod 102 which is provided to the rear of the solenoid 37. A handle 104 is secured to the eccentric rod 102 so that the roller 84 can attach or detach the roller 82 by way of rotation of the eccentric rod 102 wherein the handle 104 is rotated manually.

A keyboard is included in the typewriter of the present invention. The keyboard 106 is provided on the front inclined plate of a casing surface of a casing 108 which is detachably secured to the base element 10 by using bolts and nuts (not shown). The keyboard 106 is comprised of numbers of keys 112 which are arranged in a conventional manner. However, in the present invention, a Braille character corresponding to a printed character appears on the surface of each key 112, which also includes printed character. For example, a single dot corresponds to "A", two dots, one directly above the other, corresponds to "B", two dots, one above the other on an angle with the top dot being offset to the left, corresponds to "+" and so on. While it is not necessary to emboss the Braille characters for a blind person who has already memorized the letter arrangement on the keyboard 106, it is possible to apply the Braille character on the surface of the keys 112 with adhesive tape so that the tape may be detached when it becomes unnecessary because of memorization. An ancillary keyboard 114 is provided at the right side of the main keyboard 106 on the casing 108. The ancillary keyboard 114 is mainly comprised of a key 116 for a Braille symbol which is located at the upper point of the left side, a key 118 for a Braille symbol which is located at the middle point of left side, a key 120 for a Braille symbol which is located at the lower point of left side, a key 122 for Braille symbol which is located at the upper point of right side, a key 124 for a Braille symbol which is located at the middle point of right side, a key 126 for a Braille symbol which is located at the lower point of right side and clear keys 128 and 130. The six keys 116, 118, 120, 122, 124 and 126 are used to make a special symbol for Braille which by a combination thereof does not usually appear on the keyboard 106, for example, $\sqrt{\ }$.

Furthermore, in FIGS. 1, 2 and 3, switch 131 is an ON-OFF switch for the present device, switch 132 is an activating switch for the paper feeding motor 86 and member 134 is a buzzer to inform an individual that there is a small space remaining for typing on the recording medium.

Figure 4:
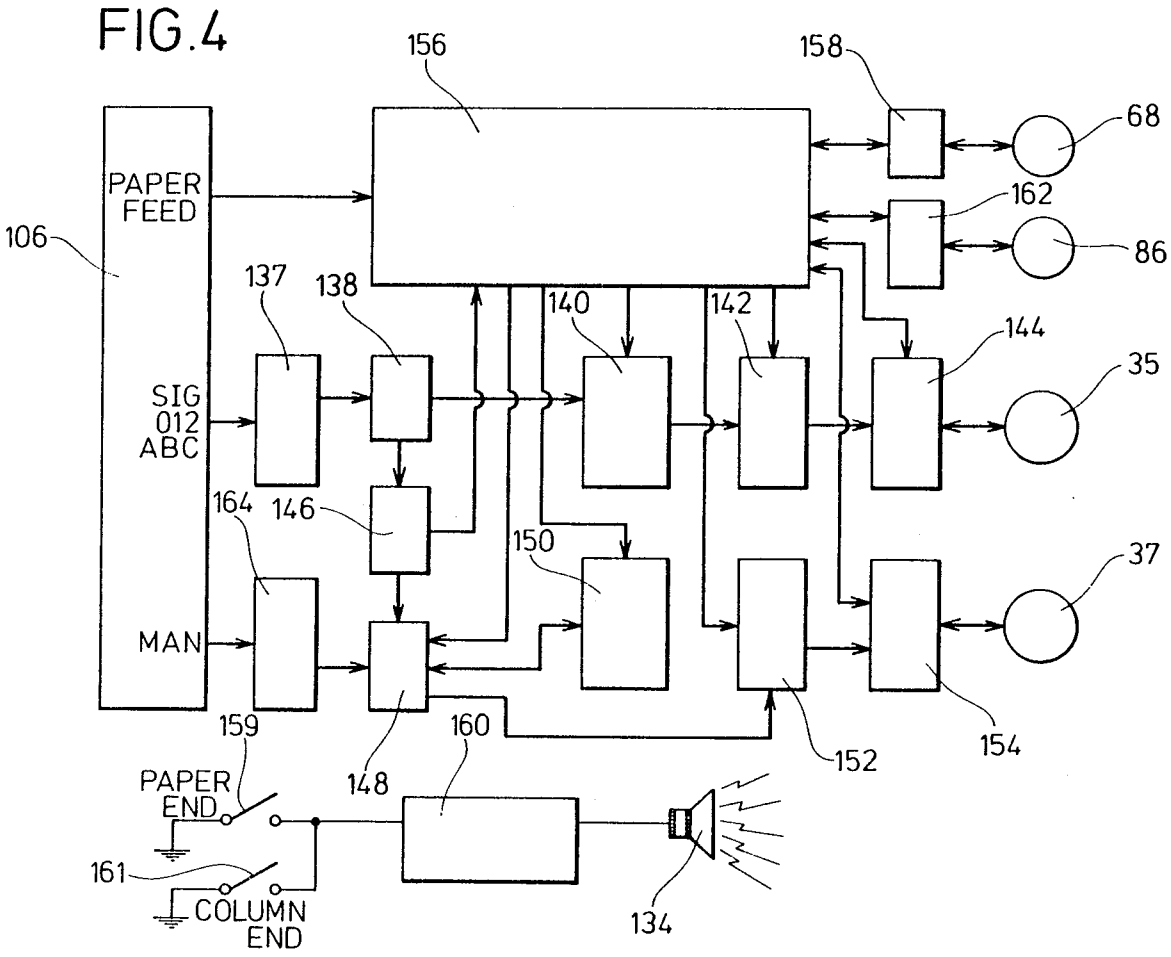
FIG. 4 is a block diagram illustrating a circuit used to operate the typewriter.
Figure 5:
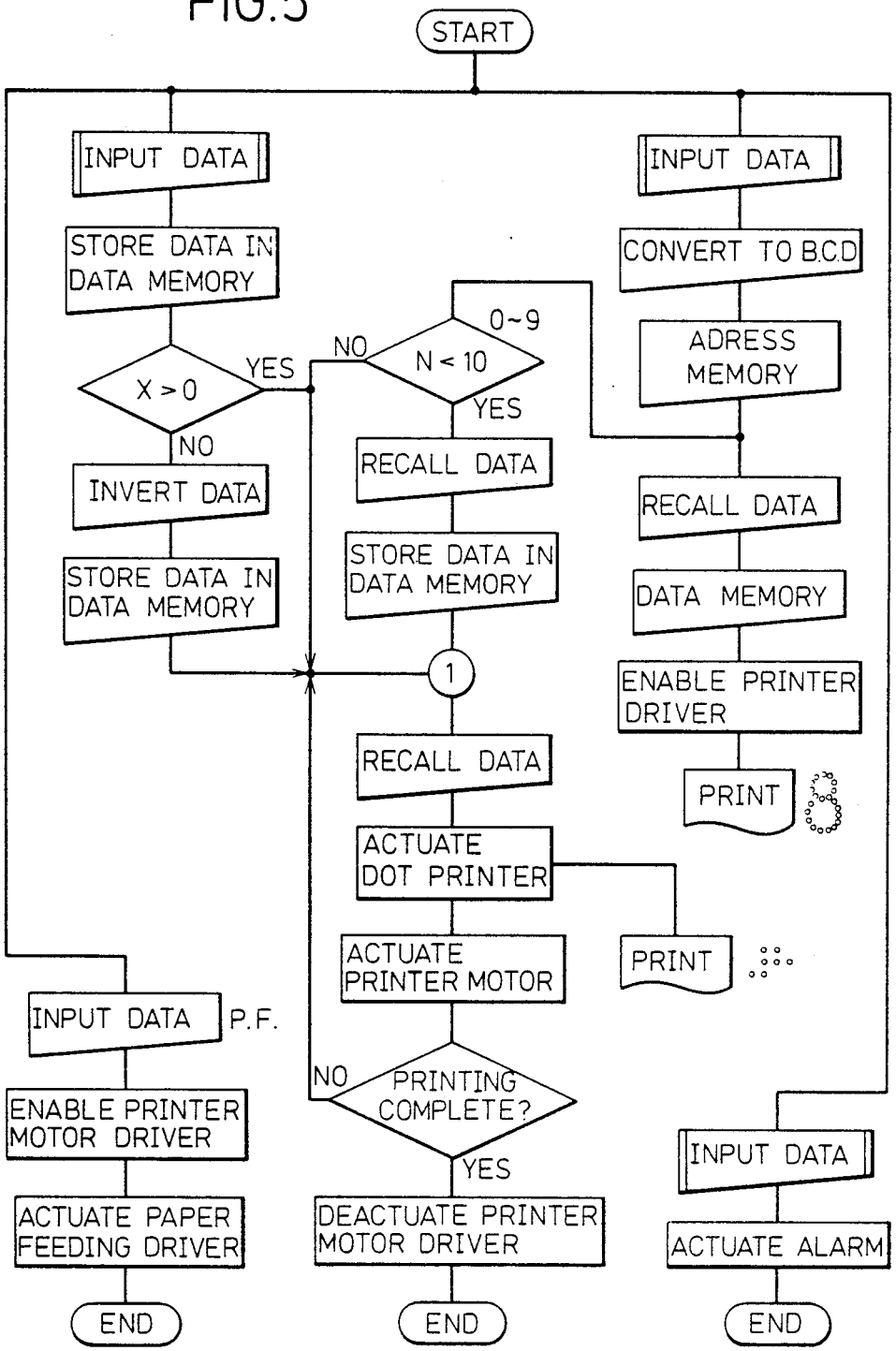
FIG. 5 is a flow chart showing the operation of the typewriter.

Operation of the present typewriter will be described hereinafter with reference to the electric circuit illustrated in FIG. 4 taken together with FIG. 5.

As illustrated in FIG. 3, at first, a recording medium, such as typing paper 136 is inserted through the flared portion into casing 76 when the roller 84 is detached from the roller 82. When the handle 104 is rotated manually, as indicated by a solid arrow R in FIG. 3, the lever 100 connected to the eccentric rod 102 pushes the roller 84 forward so that the paper 136 will be pressed onto the roller 82. After activating the typewriter by turning on the switch 131, a predetermined key 112 for both Braille and printed characters may be activated to generate a signal corresponding to the pressed key 112. The signal is transmitted to an encoder 137 (See data input process in FIG. 5) after being converted to binary coded decimal code. The converted signal is transmitted through a latch 138 and selects a signal in a data memory 140, which corresponds to the character identified by the key 112. The selected signal in the data memory 140 reaches a printer driver 144 through a shift register 142 and activates the dot printer 35 so that the selected character will be printed on the paper 136. Simultaneously, the signal generated by the key 112 reaches a data selector 148 through the latch 138 and a comparator 146 whereby a signal for a Braille symbol corresponding to the generated signal is selected from a data memory 150. The signal for a Braille is introduced to a driver 154 through a shift register 152 so as to activate the solenoids 37 to emboss on the paper 136 from the Braille symbol corresponding to the key 112 selected on the keyboard 106 on the reverse side thereof. After printing one Braille character and one corresponding printed character on the paper 136, a pulse generator 156 supplies a signal to a printer motor driver 158 thereby activating the stepping motor 68 so that the dot printer 35 and the solenoids 37 on the platform 34 are transferred laterally by the stepped belts 64 and 66 one step corresponding to a single character to be printed. When the typing of characters arrives near the end of a line on the paper, it will be detected by a conventional optical or mechanical means (not shown) to turn on a column end switch 161 so that an alarm signal driver 160 is activated to sound a signal from the buzzer 134. Simultaneously, a paper feeding motor driver 162 is activated to drive the motor 86 so as to feed the paper 136 upwardly by the roller 82 to provide a given space between successive lines. When no space remains for typing on the paper 136, similarly, it will be detected by a conventional optical or mechanical means (not shown) to turn on a paper end switch 159 so that the alarm signal driver 160 is also activated to generate a paper end signal from the buzzer 134.

As described above, since there is no key 112 which provides Braille character on the paper such as a symbol "√ ," special combination of the keys corresponding to a symbol "√ " is selected and memorized in the data memory 164 and when necessary, the special keys which are disposed on the ancillary keyboard 114 are selected. A signal generated from the keyboard 114 is transmitted to the shift register 152 through the data memory 164 and the data selector 148 so that the Braille character corresponding to the signal will be printed on the paper 136 by means of the solenoids 37. After that, the special characters or symbols corresponding to the Braille character embossed will be manually written when necessary.

According to the present invention, as illustrated above, print characters will be shown on the one side of the typing paper 136 by means of the dot printer 35 whereas Braille characters will be embossed from the other side of the typing paper by means of the solenoids 37. Thus, one sheet of paper can include both information shown in Braille and printed characters thereon so that a blind individual as well as individuals with normal vision can obtain the same contents of the information without any difficulty. Needless to say, the present device will be effectively used to transmit the information between blind persons. Furthermore, since the present device includes a dot printer as a printed character typing device, a blind person would never be bothered by embossed or recesses characters which are produced by using of ordinary printed character typing device.

This invention has been particularly shown and disclosed with reference to preferred embodiment thereof, it will be understood by those in the art that foregoing and other changes in form and details may be made therein without departing from the spirit and scope of the invention.

What is claimed is:

1. A typewriter for Braille symbols and print characters, comprising:

a housing;

a first support member extending vertically within said housing;

a second support member extending parallel to said first support member within said housing;

feeding means operatively positioned within said housing for feeding a recording medium;

Braille symbol typing means for embossing Braille symbols;

impact receiving means operatively positioned relative to said Braille symbol typing means for receiving said Braille symbol typing means for effecting a transfer of said Braille symbol unto a recording medium;

printed character typing means for producing printed characters;

first platform means operatively positioned within said housing for supporting said Braille symbol typing means on one side of a recording medium;

second platform means operatively positioned within said housing for supporting said print character typing means and said impact receiving means on the other side of a recording medium;

platform moving means for moving said first platform means and said second platform means between said first and second support members;

said platform moving means including a pulley shaft rotated by a stepping motor, a pair of pulleys mounted on end portions of said pulley shaft and first belt means and second belt means for bridging between said first platform means and second platform means and said pair of pulleys, respectively, wherein said platform moving means simultaneously, incrementally advances or retracts said platforms at least a single printed character width along a print line extending between said first and second support members on a recording medium;

a keyboard operatively positioned on said housing and including a plurality of keys each one being selectively activated to type both Braille symbols and printed characters on a recording medium by means of said Braille symbol typing means and said printed character typing means; and a casing for receiving a recording medium being provided beneath said Braille symbol typing means and printed character typing means;

wherein said Braille symbol typing means being provided at a different position in vertical orientation but at the same position along a print line relative to said printed character typing means and said Braille symbol typing means and impact receiving means being horizontally aligned with respect to each other.

2. A typewriter according to claim 1, wherein said Braille symbol typing means includes a plurality of solenoids and said print character typing means includes a dot printer.

3. A typewriter according to claim 1, wherein said first and second platform means are slidably supported on shaft members, said shaft members being bridged between said first and second supporting members which are vertically secured to a base member.

4. A typewriter according to claim 2, wherein said first and second platform means are slidably supported on shaft members, said shaft members being bridged between said first and second supporting members which are vertically secured to a base member.

5. A typewriter according to claim 1, wherein each of said belt means consist of stepped belts.

6. A typewriter according to claim 1, wherein said casing is elongated downwardly with a curved portion extending beneath said Braille symbol typing means and print character typing means.

7. A typewriter according to claim 6, wherein said casing includes a pair of openings adjacent to an upper end thereof through which rollers are operatively positioned for being pressed into contact with each other to feed said recording medium upwardly.

8. A typewriter according to claim 6, wherein said casing includes a portion which is flared upwardly at the end thereof.

9. A typewriter according to claim 1, and further comprising buzzing means being provided which generates a signal when a line to be typed on said recording medium is ended and no space remains for typing.

10. A typewriter according to claim 1, and further comprising a plurality of keys being provided for arranging a special Braille symbol not provided on said keyboard.

* * * * *